United States Patent [19]

Niems

[11] Patent Number: 4,744,155

[45] Date of Patent: May 17, 1988

[54] APPARATUS FOR REMOVING DUST FROM PYROPROCESSED PARTICULATE MATERIAL

[75] Inventor: Lee H. Niems, Flossmoor, Ill.

[73] Assignee: Kennedy Van Saun Corporation, Danville, Pa.

[21] Appl. No.: 944,973

[22] Filed: Dec. 22, 1986

[51] Int. Cl.[4] ..... F26B 17/10

[52] U.S. Cl. ..... 34/57 R; 34/79; 432/113; 432/117

[58] Field of Search ..... 34/57 R, 79, 140; 55/293; 110/246; 432/113, 117

[56] References Cited

U.S. PATENT DOCUMENTS

| | | | |
|---|---|---|---|
| 2,838,123 | 10/1958 | Niems | 432/78 |
| 2,901,837 | 9/1959 | Niems | 34/167 |
| 2,970,828 | 2/1961 | Niems | 34/57 R |
| 3,578,297 | 5/1971 | Niems | 34/20 |
| 3,720,253 | 3/1973 | Ballas | 34/79 |
| 3,721,017 | 3/1973 | Niems | 34/167 |
| 3,731,398 | 5/1973 | Neims | 34/169 |
| 4,123,850 | 11/1978 | Niems | 432/106 |
| 4,301,750 | 11/1981 | Fio Rito et al. | 110/246 |
| 4,303,477 | 12/1981 | Schmidt et al. | 110/246 |
| 4,636,301 | 1/1987 | Laramore | 55/293 |

*Primary Examiner*—Larry I. Schwartz

*Attorney, Agent, or Firm*—Charles F. Schroeder

[57] ABSTRACT

Apparatus for minimizing dust in a kiln system for pyroprocessed particulate material such as lime received from a source such as a kiln. A suction nozzle is located in close proximity to the underside of a stream of falling particles discharging from a kiln where fines are noted to be characteristically concentrated and another suction nozzle is located under an underlying grate immediately adjacent the stream of falling particles channeled through the grate and in the zone of highest concentration of fines. By thus locating the nozzles in the zones of maximum concentration of fines significant quantities of dust can be removed by utilizing only a small fraction of the air and power required with other dust removal systems.

9 Claims, 2 Drawing Sheets

APPARATUS FOR REMOVING DUST FROM PYROPROCESSED PARTICULATE MATERIAL

FIELD OF THE INVENTION

The invention relates to a method and apparatus for removing fines from kiln pyroprocessed particulate material upon flow of the material from the kiln. The invention is effective for material such as calcined lime pebbles produced from limestone heat-processed in a kiln. The term particles as used herein includes large and small pieces, pebbles, granules, broken solids, fragments, clinkers, etc. By way of example, lime particles processed in the apparatus of the invention herein described may range in size from dust less than 60 mesh to over 2 inches in size to much larger sized particles or agglomerates and kiln coating rejected from the cooler by means of grates.

Limestone is typically calcined in a kiln, such as a generally horizontal but slightly inclined rotary kiln, heated by one or more burners which subject the charge to flame temperatures in the order of 2800° F. The heated line exited from the kiln is passed through a grate and deposited in a particle bed of a cooler. The hot particle bed is force cooled by cooling air passed therethrough under pressure generally in counterflow to the mass flow of particles in the bed in the case of shaft type coolers and in cross flow to the mass flow of particles in the bed of cross flow grate type coolers.

PRIOR ART

Cooling of heated pieces of lime and other materials has been accomplished successfully in shaft type coolers such as are disclosed in my U.S. Pat. Nos. 3,578,297, 3,721,017, 3,731,398 and 4,123,850 as well as earlier U.S. Pat. Nos. 2,858,123, 2,901,837 and 2,970,828. These coolers are all within the classification of shaft type coolers wherein material is received continuously in a bed directly from a kiln and then is removed gradually downwardly to the cooler exit as cooling air is passed upwardly therethrough to cool the material. The heated air exiting from the upper region of the bed is used in the system as preheated air for combustion. In some cases, a portion of the preheated air is also used to dry pulverized coal used as fuel for the system. Although the invention is herein described specifically in relation to a system incorporating a shaft type cooler, it will be recognized as also readily useable with other cooling systems such as cross flow coolers.

THE PROBLEM

All shaft and cross flow cooler operations are characterized by a certain amount of finer sized product, under 60M for lime kilns, being blown back into the kilns. The amount of this blowback may be as low as 1%± of kiln product and acceptable in the operation or it can be an amount that will cause problems with kiln visibility, flame stability, heat transfer from the flame, ash ring buildup, preheater operation and product quality. Blowback of fines is particularly troublesome if a product such as lime has an inherent high percentage of fines under 60M size such as may be due to the initial preparation of kiln feed, or if its stone calcining characteristics result in substantial degradation, or if a high load of fines is built up via recirculation between the kiln and/or preheater and the cooler.

Previous efforts to remove fines from the cooler air stream that is returned to the kiln have consisted of either passing essentially the entire air stream through cyclones and an auxilliary fan, or blowing ambient air into the firing hood and/or cooler and through the stream of descending product and then extracting a blend of cooler air and ambient air from the firing hood and/or cooler and passing it through cyclones to separate out the dust. Although these methods have been somewhat successful in removing air borne dust they have the disadvantages of high cost of components, high operating power costs, and an adverse effect on fuel requirements and kiln capacity due to significant loss of potentially recuperable heat from the product being cooled.

The product exiting from the kiln is cooled from temperatures generally in range of 1600° F. to 2300° F. to a temperature low enough to permit its further processing including transporting the material on a rubber conveyor belt or packing in paper bags. In so cooling the material it is an objective to recuperate as much of the sensible heat in the product as possible, and to return this heat to the process in the form of preheated air for combustion or a portion may be used to dry coal if a pulverizer is used.

Blowback of fines is initiated in the following locations:

(a) In the region where product drops from a kiln to a grate or bed surface in a cooler, (b) In the region where the product drops from a grate to the bed surface in the cooler, (c) Within the interstices of the upper zone including the surface of a bed where air is at a maximum temperature and volume with consequent higher velocities than in lower zones, (d) Within the interstices of the bed in the zones of air inlets to the bed where local velocities are high, (e) At exits from the air lock standpipes from the cooler where local velocities are high and is a problem when the air is routed back from the exits to the kiln without interposing a dust collector in the circuit.

By removing most of the dust from the product as it exits the kiln and/or passes from the grate to the bed of the cooler, all significant blowback as enumerated above can be eliminated. Even though some dust will always be evolved, its quantity will be such that it will not have a materially deleterious effect on the kiln system.

BRIEF DESCRIPTION OF THE INVENTION

The invention is a method and apparatus, for pneumatic removal of dust particles from a pyroprocessed product stream exiting from a heating source such as a kiln before the particles are deposited on a cooler bed while using only 1 to 5% of the air volumes used with other dust removal systems.

As product discharges from a rotary kiln, close observation of the product stream will reveal that the finest size fraction is segregated on the side of the falling product stream closest to the discharge edge of the kiln and in the direction of rotation.

As the product discharges from a guide plate on a flat or sloped grate, the finest sized fraction is found under the product stream closest to the plate surface and on the side of the falling stream closest to the kiln.

A suction nozzle is placed in close proximity to the underside of the stream of particulate material exiting from the kiln and in other cases, under a grate between the kiln and cooler as well.

The suction nozzles have a width adequate to match the full width of the stream or alternatively only that portion with the highest concentration of fines. In this regard, one single suction section can be made to provide the desired effect or the nozzle might be made up of a number of separate or contiguous suction sections controlled to exert different removal force effects on the flowing mass. Still further, each of the nozzles can be provided separate or combined adjustability both in position of their suction zone relative to the product stream as well as the magnitude of their negative pneumatic pressure at the nozzle openings so that different magnitudes of removal force can be exerted for effective removal of dust as required.

It is a more specific objective of this invention to remove significant amounts of dust with only 1% to 5% of the mount of air that has heretofore been required for pneumatic removal and only an insignificant loss of potentially recuperable heat with consequent savings in power, kiln efficiency, production and capital expenditure.

Other objects and features which are believed to be characteristic of my invention are set forth with particularity in the appended claims. My invention, however, both in organization and manner of construction, together with further objects and features thereof may be best understood with reference to the following description taken in connection with the accompanying drawings.

THE DRAWINGS

DESCRIPTION OF THE INVENTION

Figure 1:
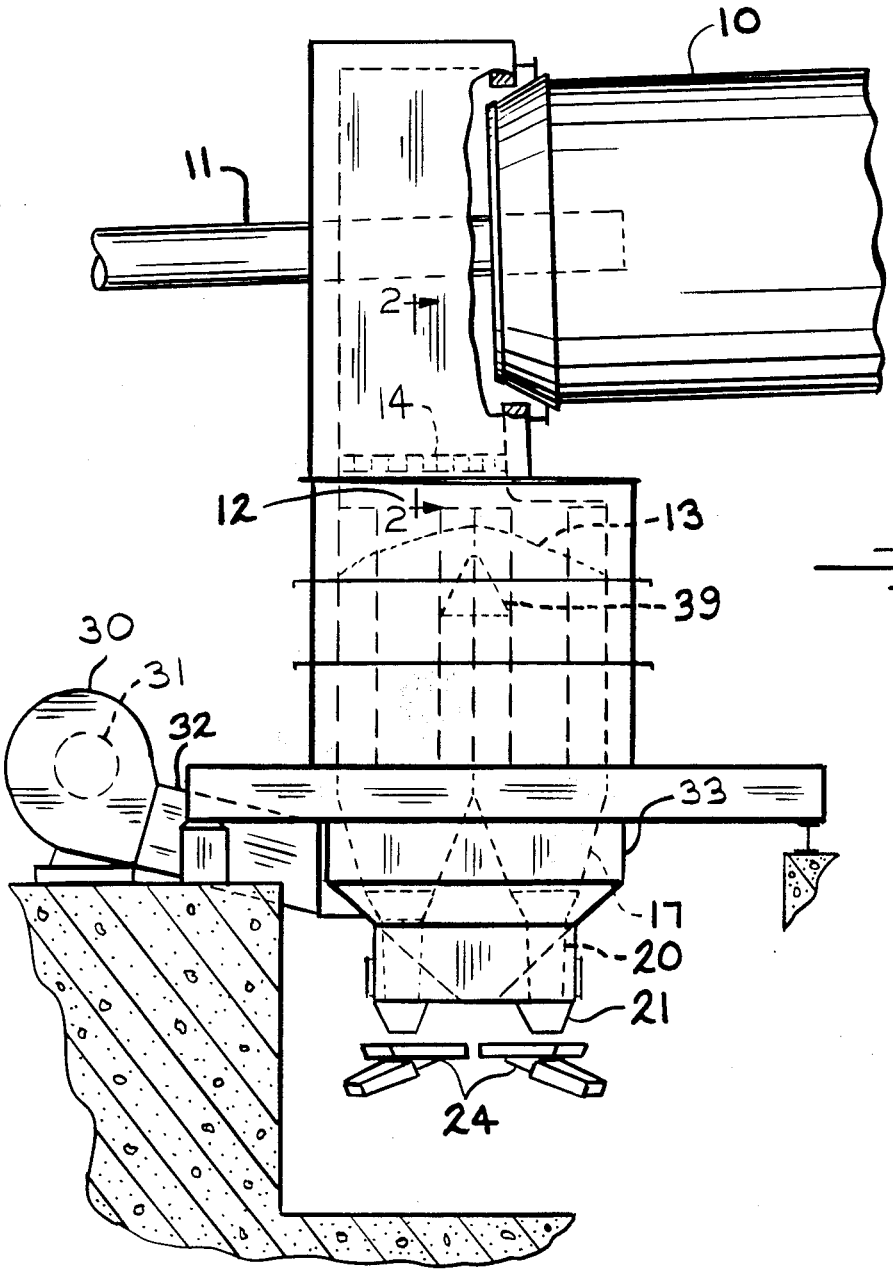
FIG. 1 is a side elevational, partially broken away view of the end portion of a kiln in operating association with an underlying shaft type cooler of the present invention.

Referring to the drawings in greater detail, FIG. 1 shows a general arrangement of components of a cooler at the end of a rotary kiln 10 in which limestone or other matter has been calcined or otherwise heat treated. Burner 11 is representative of one or more burners located on the discharge end of the kiln for supply of heat for calcination or other heat treatment of the charge. The kiln 10 is inclined slightly downwardly relative to the horizontal to promote discharge of its processed output by gravity into the cooler chamber 12. Prior to deposition of the product in the cooling bed 13, it is passed through an apertured grate 14 which separates large pieces of kiln coating or foreign matter from the product of acceptable size for treatment in the cooler. The material in the bed 13 moves generally downwardly and continuously into a cluster of four generally conically shaped hoppers 17 located in adjacent relation about the center of the bed. The material flowing through the hoppers 17 is cooled by air supplied under pressure to the bed 13 by way of a plenum 33 connected by a duct 32 to a fan 30 having a main metering inlet duct 31 open to the atmosphere. Cooled material of the bed is discharged from the hoppers 17 through exit air lock standpipes 20 onto a feeder such as electro vibrator feeders 24, which transfer the material to conveyor belts or to other processing stages.

Figure 4:
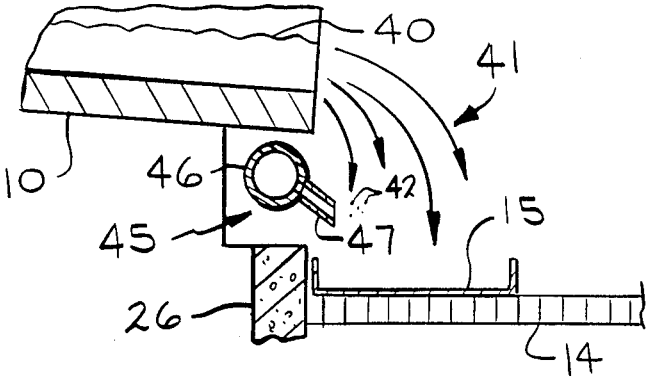
FIG. 4 is a cross-sectional elevation of the discharge region of the kiln of FIG. 2 as taken on line 4—4.
Figure 2:
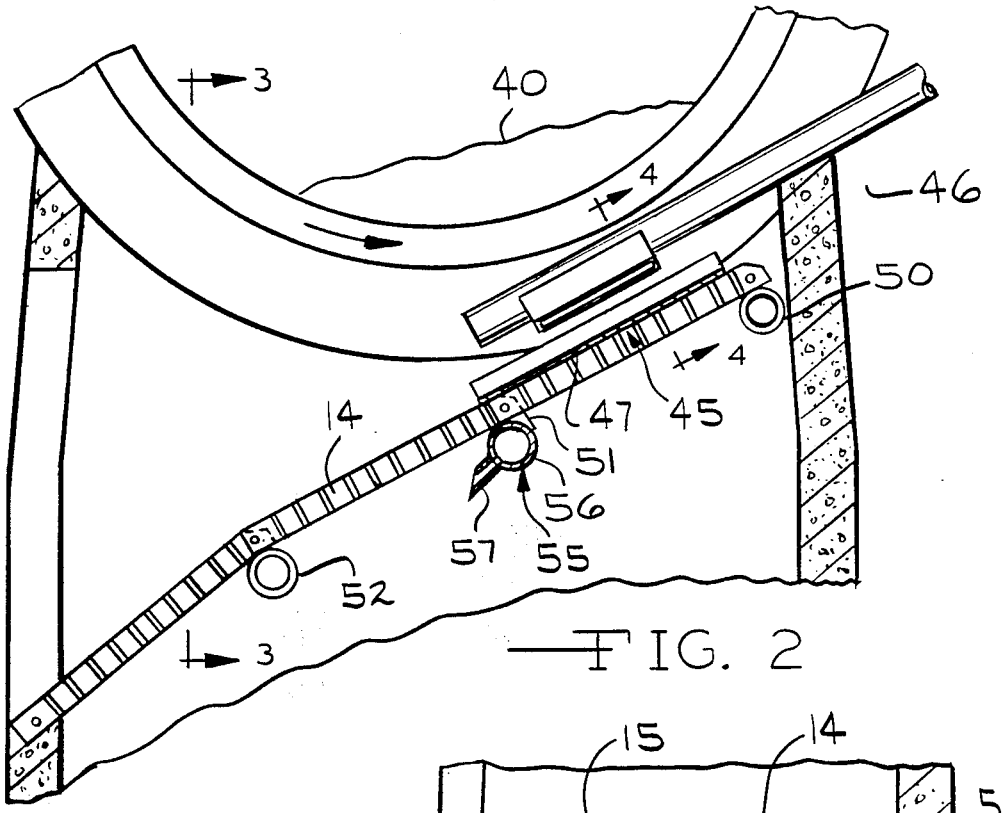
FIG. 2 is an enlarged partially broken away and partially cross-sectional view taken on line 2—2 of FIG. 1 showing the elevational arrangement of an inclined grate and the position of suction nozzles according to the present invention.
Figure 3:
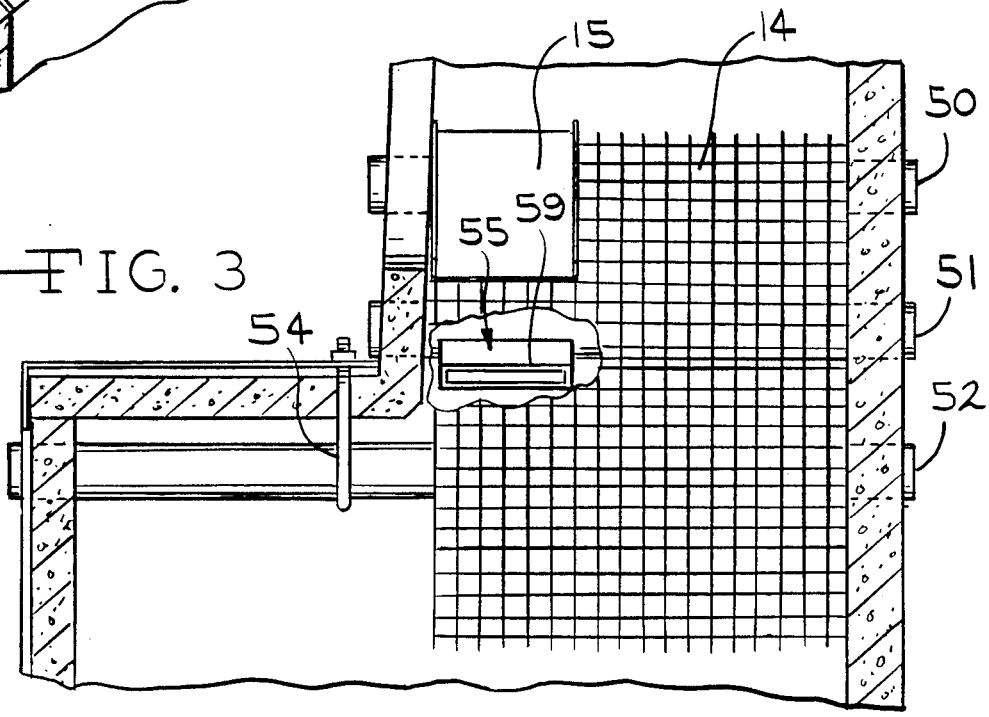
FIG. 3 is a partial cross-sectional elevation taken on line 3—3 of FIG. 2 with a portion of the grate removed and the kiln and suction head above the grate not shown.

FIG. 2 shows an elevational view of the discharge end of the kiln 11 with sloped grates 14, nozzles 45 and support beams 51. 52 amd 53. A pair of suction nozzles 47 and 57 are shown including a pair of negative pressure manifolds or suction pipes 46 and 56, respectively, connected thereto. The suction nozzle 47 is located just under the discharge end of the kiln in the product discharge zone or region as shown in FIG. 4. The product 40 flows from the kiln exit in the form of a stream over the discharge edge of the kiln laterally offset from its bottom center in the direction of rotation as the kiln rotates in a counterclockwise direction as illustrated in FIG. 2. As described hereinbefore, when the product flows from the end of the kiln, the fine particles are segregated on the side of the product stream closest to the kiln discharge end. The suction head 55 is therefore located under and adjacent the stream zone and in the direction of kiln rotation where the fines are concentrated and will effect removal of a major portion of the dust thereof from the mass as the mass falls past the nozzle.

After passage of the product past the nozzle 47 the stream of particles may be deposited upon an inclined guide plate 15 associated with the upper portion of the grates. The plate 15 is a channel-like member which acts to hold the particles in gathered condition for passage to and through the grates 14 into the central section of the cooler. The grates 14 and the plates 15 are sloped sufficiently to direct extraneous random large particles downwardly by gravity to a separate waste disposal region such as a waste pit (not shown) adjacent the cooler. The suction head 57 is located under the grate below the bottom edge of the guide plate 15 so that, again upon passage of the product through the grate, the remaining fine particles of the mass which are found to be closest to the plate and on the side closest to the kiln can be acted upon for further removal of dust.

Both pneumatic heads 45 and 57 have inlet openings such as slots sufficiently wide to cover that portion of the product stream with the highest concentration of fines if not all of the width of the product stream flowing past each, but of a total area such that the volume of air flow through the nozzles required to establish the necessary dust conveying velocities is only 1 to 5% of the volumes required by other systems. This small volume is adequate to effectively remove dust from the particle streams because of the nozzle locations in the immediate vicinity of or in the zones of finer sizes and therefore dust concentrations. The suction at the slot openings is arranged to be variable and by way of example without intention to be limiting, its magnitude may be in the order of a "1" negative pressure head.

The nozzle assemblies are made adjustably positionable in location and orientation placement of their openings in close proximity to their respective streams as well as vertically, laterally and in skewed relation to their respective stream discharge zones for the most effective removal of dust particles from the streams.

The finer fractions removed by the heads 45 and 55 can be routed, to a cyclone or other device to remove dust from this air stream and thereafter the cleaned air can be vented to either the kiln or a coal mill. If required by downstream temperature limitations, removed dust can be routed to a storage bin for holding until temperatures are low enough to permit discharge to a cooled product conveyor from the cooler or to alternate processing routes.

In view of the foregoing, while the invention has been described with regard to the illustrated embodiments, it will be recognized that my invention is not limited specifically to the particular arrangements shown and described, and accordingly, by the appended claims all modifications, adaptations and arrangements thereof are contemplated which fall within the spirit and scope of the invention.

I claim:

1. Apparatus for removing dust particles from pyroprocessed particulate material comprising in combination a rotary kiln having an exit from which such material is discharged in the form of a stream wherein the finest size fraction of said material is segregated on the side of said stream closest to the discharge edge of said kiln, a collection region for such particulate material below said kiln discharge exit, pneumatic dust collector means comprising a nozzle having a negative pressure opening located at said kiln exit adjacent the zone where said stream is discharged and closely adjacent the path of said stream on the side where the finest size fraction of the stream is segregated, said nozzle having sufficient negative pressure and being sufficiently close to said stream (discharge zone) path to selectively effect withdrawal of dust particles from a stream of particles dropping in said path before deposition of particles of said stream in said collection region.

2. An apparatus as set forth in claim 1 in which said nozzle opening is at least as wide as the zone of maximum concentration of dust in a stream flowing from said discharge zone.

3. An apparatus according to claim 1 in which said nozzle is adjustable in position and angular relation to said stream discharge zone to facilitate positioning of said opening in its most effective location for removal of dust particles from a stream discharged from said kiln.

4. Apparatus for removing dust from pyroprocessed particulate material comprising in combination a rotary kiln having a discharge exit from which such material is supplied in stream form, a collection region for such particulate material below said kiln discharge exit, an apertured grate between said kiln exit and said collection region, said grate having apertures of size which permit particles of less than a predetermined size to pass therethrough to said collection region, a pneumatic dust collector comprising a nozzle having a negative pressure opening located under said grate in close adjacent relation to the path where the maximum concentration of dust of said particles is passed through said grate, said dust collector providing sufficient negative pressure at said nozzle to selectively withdraw dust particles from particles passed through said grate before deposition of said particles in said collection region.

5. Apparatus as set forth in claim 1 in which said nozzle opening is at least as wide as the zone of maximum concentration of dust in the mass of particles passed through said grate.

6. Apparatus as set forth in claim 5 in which said grate is angularly oriented to direct material deposited thereon larger than said predetermined size to a separate large particle collection zone.

7. The apparatus of claim 6 in which channelling means is provided in association with said grate to channel particles received from said kiln to a passage zone before the particles are passed through said grate.

8. Apparatus for removing dust from pyroprocessed particulate material comprising in combination a rotary kiln having a discharge exit from which such material is discharged in stream form, a collection region for such particulate material below said kiln exit, a first pneumatic dust collector comprising a nozzle having a negative pressure opening located below said kiln exit adjacent the zone where said stream is discharged and closely adjacent the side of the path of said stream where the finest size fraction of said material is concentrated, a grate having apertures of size which permit particules of less than a predetermined size to pass therethrough to said collection region, a second pneumatic dust collector comprising a nozzle having a negative pressure opening located under said grate adjacent to the zone and the path where said particles pass as a stream through said grate, said dust collectors each providing sufficient negative pressure at their respective nozzle openings and said openings being sufficiently close to the paths of said (stream) streams on the side where the maximum concentration of dust is present (zones) for effective withdrawal of dust particles from the respective streams of particles passed thereby.

9. Apparatus as set forth in claim 8 in which said nozzles are each adjustable for positioning of their respective openings in proximity, vertically, laterally and in skewed relation (to their) with the respective (stream zones) stream with which each is associated for most effective removal of dust particles from the mass of particles passed thereby.

* * * * *